US007448621B2

(12) United States Patent
Yasumoto

(10) Patent No.: US 7,448,621 B2
(45) Date of Patent: Nov. 11, 2008

(54) SHEET CONVEYING APPARATUS AND IMAGE FORMING APPARATUS

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 389 days.

(21) Appl. No.: 11/088,758

(22) Filed: Mar. 25, 2005

(65) Prior Publication Data

US 2005/0214027 A1 Sep. 29, 2005

(30) Foreign Application Priority Data

Mar. 29, 2004 (JP) ..... 2004-096919

(51) Int. Cl.
*B65H 5/00* (2006.01)

(52) U.S. Cl. ..... 271/264; 399/124; 399/110

(58) Field of Classification Search ..... 271/259, 271/258.01, 256, 264, 273, 274; 399/110, 399/113, 114, 124, 125
See application file for complete search history.

(56) References Cited

U.S. PATENT DOCUMENTS 4,412,734 A * 11/1983 Shibuya et al. ..... 399/124
5,052,670 A * 10/1991 Makiura et al. ..... 271/9.13
6,571,074 B2 * 5/2003 Suzuki et al. ..... 399/124
6,757,506 B2 * 6/2004 Kahn ..... 399/124
6,973,279 B2 * 12/2005 Yokoi ..... 399/124
2005/0214027 A1 9/2005 Yasumoto ..... 399/124
2005/0214028 A1 9/2005 Yasumoto ..... 399/124

FOREIGN PATENT DOCUMENTS

JP 4-7227 * 1/1992
JP 2003-98777 4/2003

* cited by examiner

*Primary Examiner*—Patrick Mackey
*Assistant Examiner*—Thomas A Morrison
(74) *Attorney, Agent, or Firm*—Fitzpatrick, Cella, Harper & Scinto

(57) ABSTRACT

A sheet conveying apparatus in which a sheet conveying path is opened by opening a casing rotatably mounted to an apparatus main body, the sheet conveying apparatus including: a first sheet conveying path that is opened by opening the casing; a second sheet conveying path arranged deeper in the apparatus main body than the first sheet conveying path and joining the first sheet conveying path; a first guide member constituting one side of the first sheet conveying path at a joining portion where the first sheet conveying path and the second sheet conveying path join each other; a first guide support member arranged between the first sheet conveying path and the second sheet conveying path and rotatable while supporting the first guide member; a second guide member constituting one side of the second sheet conveying path at the joining portion; and a second guide support member arranged between the first sheet conveying path and the second sheet conveying path and rotatable while supporting the second guide member. When the casing is opened, the first guide support member and the second guide support member rotate independently of each other to open the second sheet conveying path.

16 Claims, 12 Drawing Sheets

SHEET CONVEYING APPARATUS AND IMAGE FORMING APPARATUS

BACKGROUND OF THE INVENTION

1. Field of the Invention

The present invention relates to a sheet conveying apparatus for conveying sheets and an image forming apparatus, and more particularly to the construction of a sheet conveying path joining portion.

2. Related Background Art

Conventionally, in an image forming apparatus, such as a printer, a facsimile apparatus, a copying machine, or a printing machine, an image is formed by an electrophotographic system, an offset printing system, an ink-jet system, and the like. An example of such the image forming apparatus is a color image forming apparatus forming a color image by the electrophotographic system. From the viewpoint of construction, such color image forming apparatus can be roughly classified into a tandem type apparatus in which the image forming portion is composed of a plurality of image forming units that are arranged side by side, and a rotary type apparatus in which a plurality of image forming units are arranged in a cylindrical form, and, from the viewpoint of transfer system, they can be classified into a direct transfer system in which a toner image is directly transferred from a photosensitive member to a sheet, and an intermediate transfer system in which a toner image is temporarily transferred to an intermediate transfer member before being transferred to a sheet.

Here, in the intermediate transfer tandem system, in which a plurality of image forming units are arranged side by side on the intermediate transfer belt, there is no need to hold the sheet on the transfer drum or the transfer sheet as in the case of the direct transfer system, so that it is applicable to various types of sheet, such as an ultra-thick sheet or a coated sheet; the sheet conveying path up to the secondary transfer portion can be made simple; and the degree of freedom in stretching the intermediate transfer belt is high, which means the system is advantageous also in terms of a reduction in the size of the image forming apparatus.

Further, in addition to the above advantages, the tandem system is characterized by parallel processing in a plurality of image forming units and collective transfer of a full color image, which leads to a construction highly advantageous in achieving an increase in processing speed, making the system suitable as a color image forming apparatus intended for high productivity.

Incidentally, such a color image forming apparatus is equipped with sheet conveying paths, such as a sheet conveying path for conveying a sheet accommodated in a sheet feeding cassette to an image forming portion, and a sheet re-conveying path for conveying a sheet with an image formed on one side thereof to the image forming portion after reversing the sheet. The sheet conveying path and the sheet re-conveying path are each equipped with a guide means for guiding the sheet and a sheet conveyance rotary member for conveying the sheet along the guide means. Here, examples of the guide means include a plate-like guide member having a conveyance surface. Further, examples of the sheet conveyance rotary member include a roller pair adapted to convey a sheet while holding it with a predetermined pressurizing force, and a conveying belt adapted to convey a sheet while sucking and holding a sheet by static electricity, air, etc. In the case of a sheet conveying apparatus conveying a sheet by means of a conveying belt, the conveying belt may serve as both the guide means and the sheet conveyance rotary member.

Incidentally, when sheet jamming occurs near the joining portion of the sheet conveying path and the sheet re-conveying path, it is necessary to widely open the sheet conveying path for improved operability in order to extract the jammed sheet or the sheet kept at rest due to jamming.

In view of this, as disclosed, for example, in JP 2003-98777 A, a construction is available in which the sheet re-conveying path portion is formed into a unit that can be drawn out of the image forming apparatus main body to the front side thereof and in which a guide plate constituting the joining portion of the sheet conveying path and the sheet re-conveying path can be opened sidewise. In this construction, when sheet jamming occurs in the joining portion of the sheet conveying path and the sheet re-conveying path, the unit is first drawn out to the front side, and the guide plate is opened sidewise, thereby making it possible to remove the jammed sheet. Since the guide plate can be widely opened, the operability in jam processing is satisfactory.

However, in the construction as disclosed in JP 2003-98777 A, in which the sheet re-conveying path portion is formed into a unit and in which the guide plate at the portion where the sheet conveying path and the sheet re-conveying path join can be opened sidewise, there is involved a problem in terms of the rigidity of the image forming apparatus while it is advantageous in that the operability in jam processing outside the apparatus is improved.

In the case of recent tandem type color image forming apparatuses or color image forming apparatuses having an intermediate transfer belt, the transfer belt and the intermediate transfer belt are formed into units that can be drawn out from viewpoint of maintenance property, etc. Further, when a construction is adopted in which the sheet conveying apparatus including the sheet re-conveying path is formed into a unit that can be drawn out, a plurality of heavy units, such as the intermediate transfer belt and the sheet conveying apparatus, are to be drawn out, so that the casing of the image forming apparatus main body must have a sufficiently high strength. If the strength of the casing is insufficient, the connection between units is rather unstable, so that jamming is likely to occur and there is a fear of the image quality being degenerated.

In a high-end image forming apparatus, of which high image quality and high productivity are required, there are involved an increase in weight burden due to the draw-out construction, and jam generation, defective image quality, etc. due to the deficiency in rigidity, so that it is necessary to enhance the rigidity of the casing of the image forming apparatus, resulting in an increase in the size and weight of the apparatus.

In view of this, there has been proposed a construction which is arranged by the side of the image forming apparatus and adapted to effect jam processing on the sheet conveying apparatus including the joining portion of the sheet conveying path and the sheet re-conveying path from the side of the image forming apparatus.

As shown in FIG. 11, this construction is equipped with a sheet conveying path 1 for conveying a sheet sent out from a sheet feeding portion C composed of a sheet feeding cassette, a sheet feeding roller, etc., and a sheet re-conveying path 2 situated on the inner side of the sheet conveying path 1 and adapted to convey a sheet with an image formed on one side thereof to an image forming portion again. The sheet conveying path 1 is equipped with an inner guide plate 67 with an inner guide and a casing 63 with an outer guide, with the casing 63 being rotatable around a rotation shaft 64. When jamming has occurred in the sheet conveying path 1, the casing 63 is, as shown in FIG. 12, rotated to open in the direction of the arrow P around the rotation shaft 64 to separate conveying roller pair 70, 71 arranged in the sheet conveying path from each other, whereby it is possible to remove the staying sheet. While in FIG. 11 the rotation shaft 64 is situated in the lower portion of the casing 63, this should not be construed restrictively; the rotation shaft 64 may also be situated in the upper portion, on the depth side, etc. of the casing.

While the sheet conveying path 1 thus allows access to the sheet relatively easily by opening the casing 63, the sheet re-conveying path 2 situated on the inner side of the sheet conveying path 1 does not allow access to the sheet solely by opening the outer casing 63.

In view of this, a leading edge guide member 62 forming the joining portion of the sheet conveying path 1 and the sheet re-conveying path 2 is provided so as to be rotatable around a rotation shaft 68, and the leading edge guide member 62 is urged by an elastic member 65 so as to open the sheet re-conveying path 2 as shown in FIG. 12. When removing a jammed sheet S, the casing 63 is rotated around the rotation shaft 64 as shown in FIG. 12, whereby the leading edge guide member 62 is also moved downwards around the rotation shaft 68 by the elastic member 65, making it possible to enlarge the opening of the sheet re-feeding path 2. Then, the staying sheet S is drawn out in the direction of the arrow and removed from the opening thus enlarged.

Here, an attempt to draw out the sheet S in the state in which it is held by a conveying roller pair 60, 61 inside the sheet re-conveying path 2 results, for example, in the sheet S being torn off at the time of removal to leave a piece of paper inside the apparatus. In view of this, a built-in one-way clutch 66, for example, is provided in the conveying roller 60, which is caused to make idle rotation in the direction of the arrow F as the sheet S held by the conveying roller pair 60, 61 is drawn out during jam removal, thereby enabling the sheet S to be drawn out easily.

However, in this jam processing construction, the leading edge guide member 62 cannot be widely opened, so that the jam processing in the sheet re-conveying path 2 has to be conducted in a small space, resulting in a very poor operability. That is, an attempt to greatly rotate the leading edge guide member 62 in order to enlarge the jam processing space results in the proximal end of the leading edge guide member 62 interfering with the inner guide plate 67 or with the upper, stationary guide of the sheet re-conveying path 2, so that the leading edge guide member 62 cannot be opened widely. It might be possible to integrate the leading edge guide member 62 with the inner guide member 67 and to downwardly rotate the inner guide member 67 integrally with the leading edge guide member 62 to thereby enlarge the opening of the sheet re-conveying path 2. However, in this case also, the proximal end of the guide member would interfere with the member of the sheet feeding portion C upon rotation of the guide member, or interfere with the stationary, upper guide of the sheet re-conveying path 2, which means the leading edge guide member cannot be opened widely. In this way, the inner guide member of the joining portion of the sheet conveying paths is restricted in rotation range, so that the sheet re-conveying path cannot be widened to a sufficient degree. Thus, to achieve an improvement in operability for jam processing, there is a demand for a construction which allows the sheet re-conveying path 2 to be widely opened.

SUMMARY OF THE INVENTION

The present invention has been made with a view toward solving the above problems in the prior art. It is an object of the present invention to provide a sheet conveying apparatus which is compact and which allows jam processing to be conducted easily, and an image forming apparatus equipped with the same.

According to the present invention, there is provided a sheet conveying apparatus including: a first sheet conveying path that is opened by opening a casing rotatably mounted to an apparatus main body; a second sheet conveying path arranged from the first sheet conveying path to the inside or more of the apparatus main body and joining the first sheet conveying path; a first guide member constituting one side of the first sheet conveying path at a joining portion where the first sheet conveying path and the second sheet conveying path join each other; a first guide support member arranged rotatably between the first sheet conveying path and the second sheet conveying path and supporting the first guide member; a second guide member constituting one side of the second sheet conveying path at the joining portion; and a second guide support member arranged rotatably between the first sheet conveying path and the second sheet conveying path and supporting the second guide member, in which, when the casing is opened, the first guide support member and the second guide support member rotate independently of each other to open the second sheet conveying path.

DESCRIPTION OF THE PREFERRED EMBODIMENTS

In the following, the best mode for carrying out the present invention will be described in detail with reference to the drawings.

Figure 1:
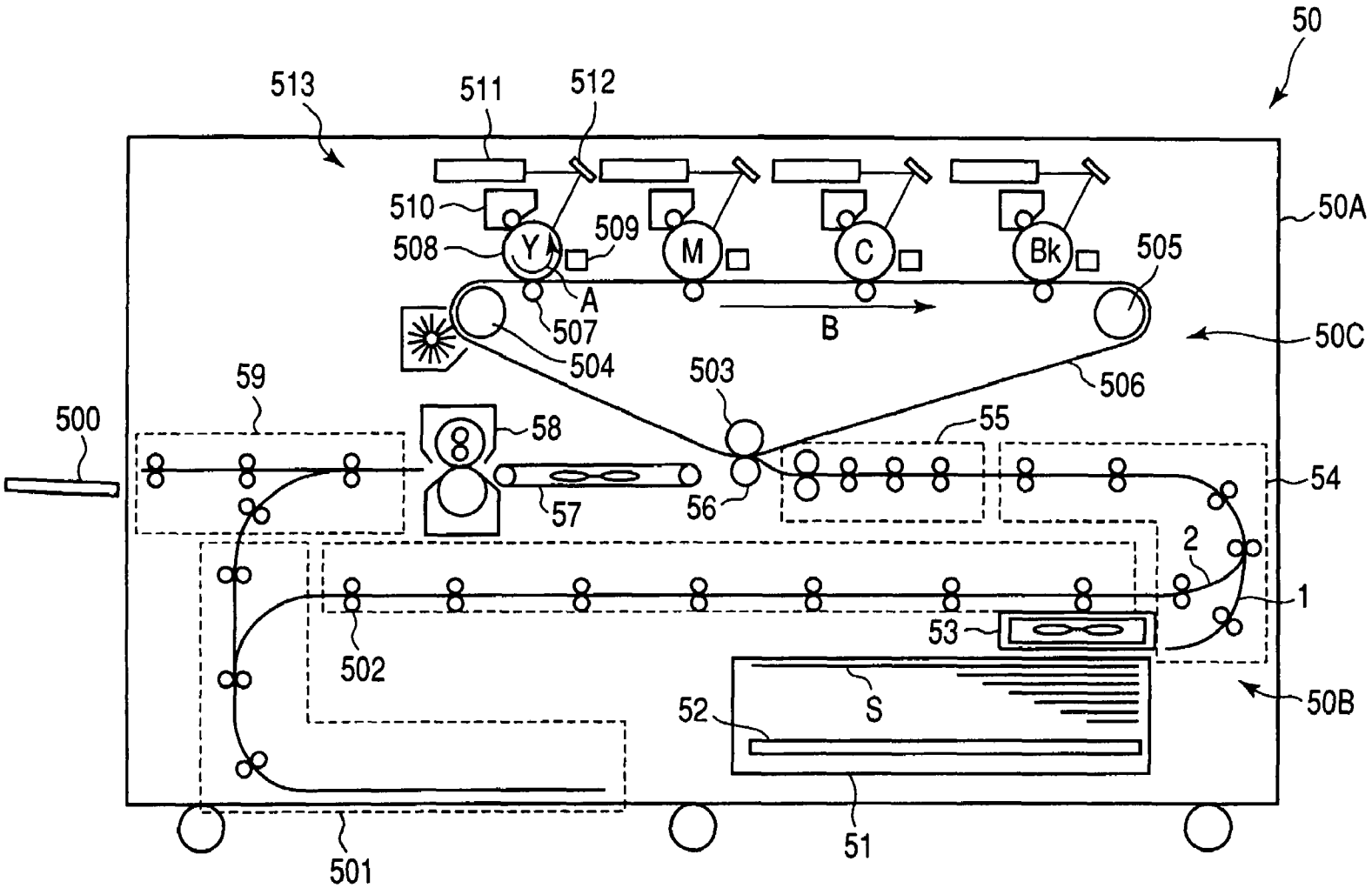
FIG. 1 is a diagram showing the general construction of a color image forming apparatus constituting an example of an image forming apparatus equipped with a sheet conveying apparatus according to an embodiment of the present invention.

FIG. 1 is a diagram showing the general construction of a color image forming apparatus constituting an example of an image forming apparatus equipped with a sheet conveying apparatus according to an embodiment of the present invention.

In FIG. 1, a color image forming apparatus main body (hereinafter referred to as the apparatus main body) 50A of a color image forming apparatus 50 is equipped with an image forming portion 513, a sheet feeding portion 50B that conveys a sheet S, and a transfer portion 50C that transfers a toner image formed by the image forming portion 513 to the sheet S fed by the sheet feeding portion 50B.

Here, the image forming portion 513 is equipped with image forming units for yellow (Y), magenta (M), cyan (C), and black (Bk) each composed of a photosensitive member 508, an exposure device 511, a developing device 510, a primary transfer device 507, a photosensitive member cleaner 509, etc. That is, the color image forming apparatus of this embodiment is an intermediate transfer tandem type one whose image forming portion is formed by image forming units for four colors arranged side by side on an intermediate transfer belt described below. The colors of the image forming units are not restricted to these four colors, nor is the color arrangement order restricted to the above-mentioned one.

Further, the sheet feeding portion 50B is equipped with a sheet accommodating portion 51 in which the sheets S are stacked together on a lift-up device 52, and a sheet feeding means 53 for sending out the sheets S accommodated in the sheet accommodating portion 51. The sheet feeding means 53 may be of a type utilizing frictional separation by a feeding roller or the like, a type utilizing separation/attraction by air, etc. This embodiment adopts, by way of example, the sheet feeding system utilizing air.

Further, the transfer portion 50C is equipped with an intermediate transfer belt 506 stretched between rollers, such as a driving roller 504, a tension roller 505, and an inner secondary transfer roller 503, and adapted to be driven in the direction of the arrow B in FIG. 1.

Here, a toner image formed on the photosensitive member is transferred to the intermediate transfer belt 506 by a predetermined pressurizing force and electrostatic load bias imparted by the primary transfer device 507, and a predetermined pressurizing force and electrostatic load bias are imparted thereto at a secondary transfer portion formed by the inner secondary transfer roller 503 and an outer secondary transfer roller 56 substantially opposed to each other, whereby an unfixed image is attracted to the sheet S.

When forming an image by the color image forming apparatus 50 constructed as described above, light is first emitted from the exposure device 511 based on a signal representing image information sent, and this light is applied, via a reflection means 512, etc. to the photosensitive member 508 whose surface is previously uniformly charged by a charging means (not shown) and which rotates in the direction indicated by the arrow A in FIG. 1, with the result that a latent image is formed. A slight amount of transfer residual toner remaining on the photosensitive member 508 is recovered by the photosensitive member cleaner 509 for the next image formation process.

Next, toner development is effected by the developing device 510 on the electrostatic latent image thus formed on the photosensitive member 508, thereby forming a toner image on the photosensitive member. Thereafter, a predetermined pressurizing force and electrostatic load bias are imparted by the primary transfer device 507, and the toner image is transferred to the intermediate transfer belt 506.

The image formation by the respective image forming units for Y, M, C, and Bk of the image forming portion 513 is effected such that toner images are superimposed one after the other on the upstream toner image on the intermediate transfer belt obtained through primary transfer. As a result, a full color toner image is finally formed on the intermediate transfer belt 506.

Further, the sheet S is sent out by the sheet feeding means 53 in conformity with the image forming timing of the image forming portion 513. Thereafter, the sheet S is conveyed to a registration unit 55 by way of a sheet conveying path 1 provided in a sheet conveying apparatus 54. Then, after skew feed correction, timing correction, etc. are conducted in the registration unit 55, the sheet S is conveyed to the secondary transfer portion formed by the inner secondary transfer roller 503 and the outer secondary transfer roller 56 to thereby effect secondary transfer of the full color toner image to the sheet S at the secondary transfer portion.

Next, the sheet S, to which the toner image has been thus secondarily transferred, is conveyed to a fixing device 58 by a pre-fixing conveying portion 57. Then, in the fixing device 58, a predetermined pressurizing force caused by substantially opposing rollers, belt, etc., and a heating effect generally obtained by a heat source, such as a heater, are applied to the sheet S to thereby fuse and fix the toner to the sheet S.

Next, the sheet S with the fixed image thus obtained is discharged as it is onto a discharge tray 500 by a branching/conveying device 59. When images are to be formed on both surfaces of the sheet S, the sheet S is then conveyed to a reversal conveying device 501 through switching a switching flapper (not shown).

Here, when the sheet S is thus conveyed to the reversal conveying device 501, the leading and trailing edges of the sheet S are exchanged through switch-back operation, and the sheet is conveyed to a duplex conveying device 502. Thereafter, in synchronism with a sheet for the subsequent job conveyed from the sheet feeding apparatus 50B, the sheet joins from the sheet re-conveying path 2 of the sheet conveying apparatus 54, and is likewise sent to the secondary transfer portion. Regarding the image forming process, it is the same as that for the first side, so that a description thereof will be omitted.

Figure 2:
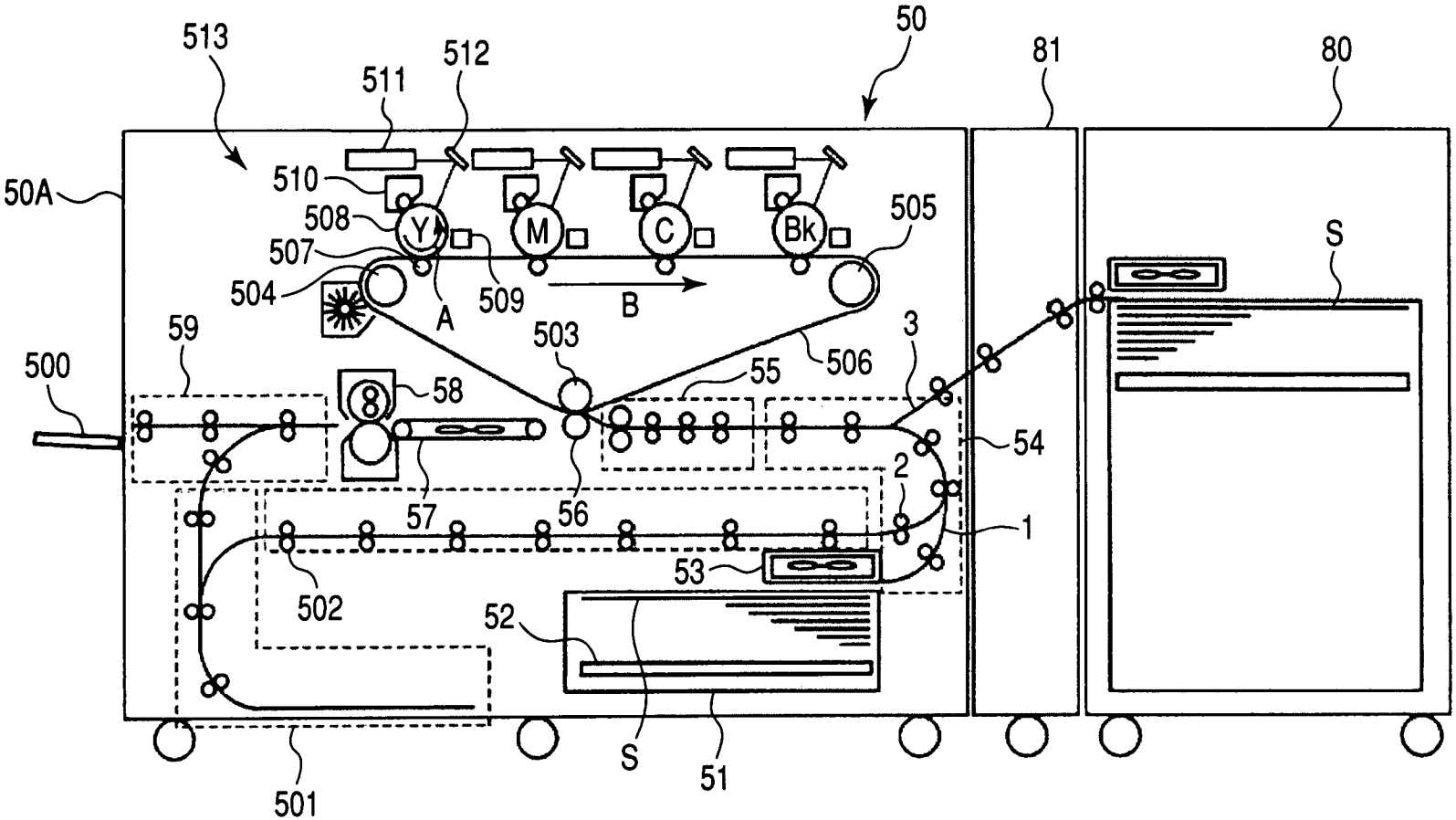
FIG. 2 is an explanatory view of another construction of the color image forming apparatus.

For high productivity, the color image forming apparatus 50 allows connection of a large-capacity sheet feeding apparatus 80 as shown in FIG. 2 as an option through the intermediation of a connection device 81. Here, in the color image forming apparatus 50 allowing connection to the large-capacity sheet feeding apparatus 80 described above, when an image is to be formed on a sheet S accommodated in the large-capacity sheet feeding apparatus 80, the sheet S from the large-capacity sheet feeding apparatus 80 is conveyed to the image forming portion 513 by way of an option conveying path 3.

Figure 3:
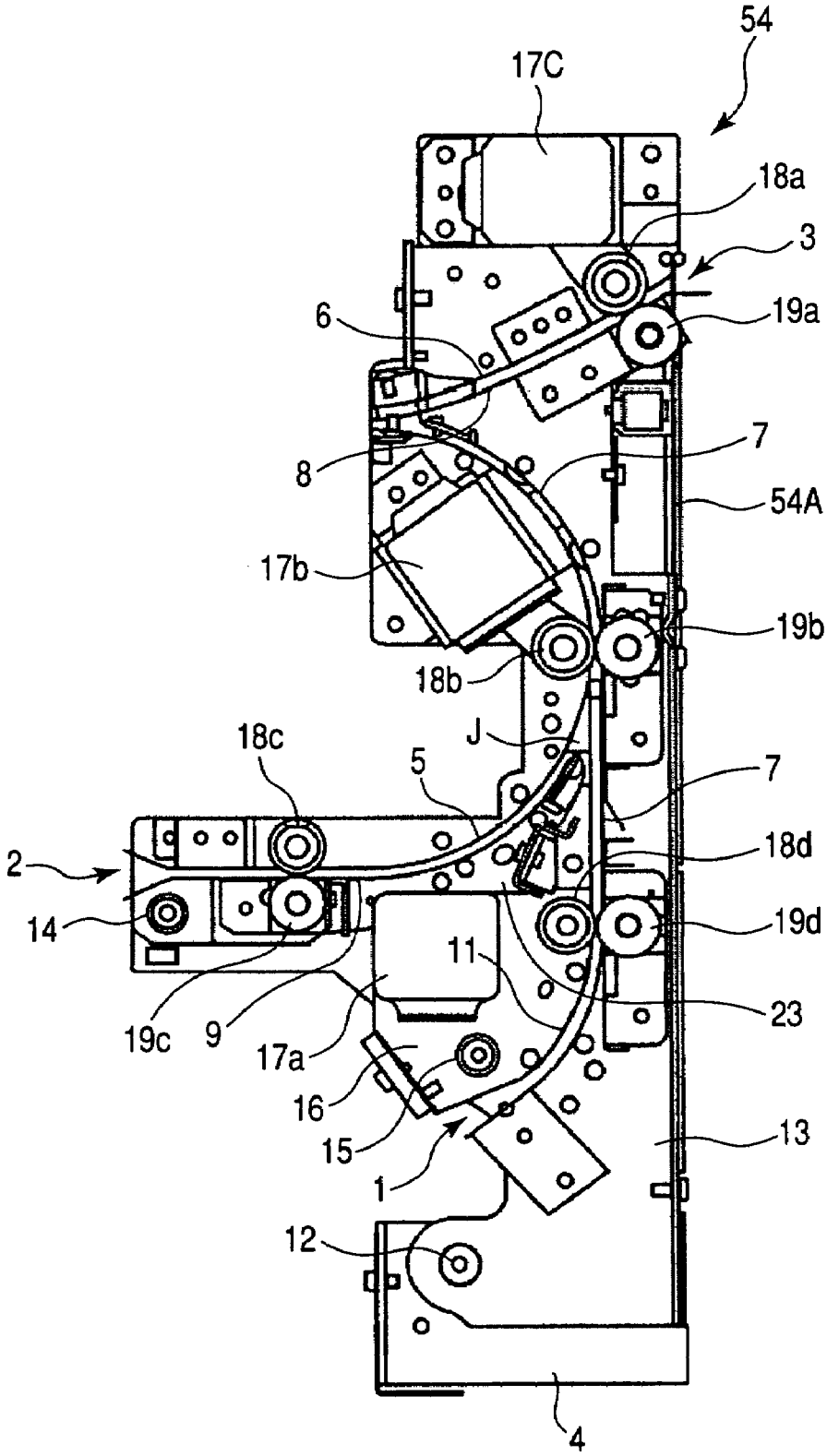
FIG. 3 is a diagram illustrating the construction of the sheet conveying apparatus.

FIG. 3 is a diagram illustrating the construction of the sheet conveying apparatus 54. FIG. 3 shows the construction of the sheet conveying apparatus 54 allowing connection of the large-capacity sheet feeding apparatus 80 shown in FIG. 2.

FIG. 3 shows a first guide plate 5 and a second guide plate 9 forming the sheet re-conveying path 2, a third guide plate 6 and a fourth guide plate 8 forming the option conveying path 3, and a fifth guide plate 11 and a sixth guide plate 7 forming the sheet conveying path 1.

Here, the first guide plate 5 and the third guide plate 6 are fixed by a rear side plate 4 and a front side plate (not shown) forming a sheet conveying apparatus main body 54A. The sixth guide plate 7 and the fourth guide plate 8 are fixed to a door-like casing 13 rotatably supported by the front side plate and the rear side plate through the intermediation of a rotation shaft 12. The second guide plate 9 is fixed to a guide support member 23 as a second guide support member rotatably supported by the front side plate and the rear side plate through the intermediation of a rotation shaft 14. Further, the fifth guide plate 11 is fixed to a sub-casing 16 as a first guide support member rotatably supported by the front side plate and the rear side plate through the intermediation of a rotation shaft 15. Inside the apparatus main body, the rotation shaft 14 is arranged on the inner side of the rotation shaft 15. By making the distance between the rotation shaft 14 and the forward end of the joining portion large, greater movement of the forward end of the joining portion is possible at the same rotation angle, so that it is possible to widely open the sheet re-conveying path.

As shown in FIG. 3, the sheet conveying path 1 constituting the first sheet conveying path is formed by the fifth guide plate 11 and the sixth guide plate 7, and the sheet re-conveying path 2 constituting the second sheet conveying path is formed by the second guide plate 9 and the first guide plate 5. The joining portion J where the sheet conveying path 1 and the sheet re-conveying path 2 join each other is formed by the second guide plate 9 forming the sheet re-conveying path 2 and the fifth guide plate 11 forming the sheet conveying path 1. That is, the joining portion J where the sheet re-conveying path 2 and the sheet conveying path 1 join each other is formed by two separate guide plates: the second guide plate 9 and the fifth guide plate 11.

Symbols 18*a* and 19*a* indicate a driving roller and a driven roller provided in the option conveying path 3, symbols 18*b* and 19*b* indicate a driving roller and a driven roller provided on the downstream side of the joining point of the sheet conveying path 1 and the sheet re-conveying path 2, symbols 18*c* and 19*c* indicate a driving roller and a driven roller as sheet conveying rotary members provided in the sheet re-conveying path 2, and symbols 18*d* and 19*d* indicate a driving roller and a driven roller provided in the sheet conveying path 1. The respective driving rollers 18*a* through 18*d* and the driven rollers 19*a* through 19*d* are held in contact with each other with a predetermined pressurizing force.

Symbol 17*a* indicates a first motor for driving the driving roller 18*d* and the driven roller 19*d*, symbol 17*b* indicates a second driving motor for driving the driving rollers 18*b* and 18*c* and the driven rollers 19*b* and 19*c*, and symbol 17*c* indicates a third motor for driving the driving roller 18*a* and the driven roller 19*a*.

Figure 4:
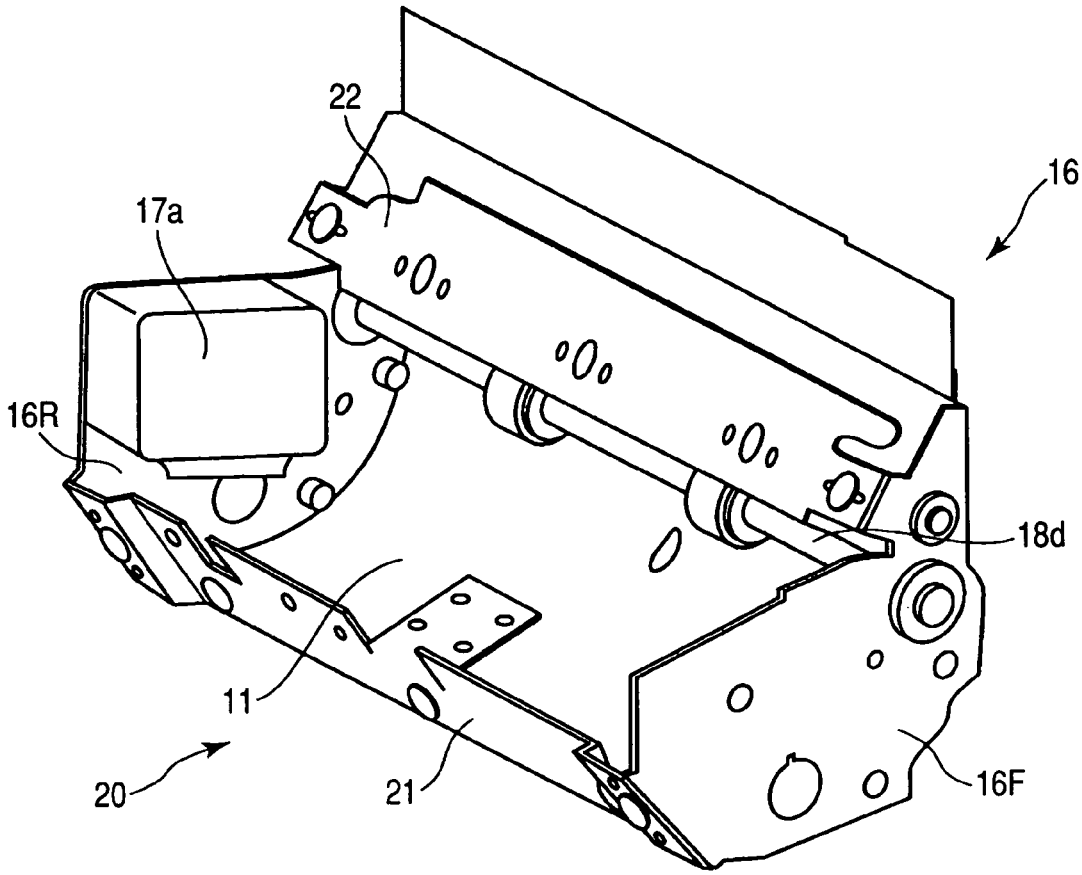
FIG. 4 is a perspective view of the construction of a sub-casing provided in the sheet conveying apparatus.

FIG. 4 is a perspective view showing the construction of the sub-casing 16 which is a support member fixing the fifth guide 11. The sub-casing 16 is equipped with side plate members 16F and 16R opposed to each other, and reinforcing plates 21 and 22 provided between the side plate members 16F and 16R so as to ensure rigidity. In this embodiment, in the bag-shaped space surrounded by the fifth guide plate 11 and the side plate members 16F and 16R, there are arranged the driving roller 18*d* and the first motor 17*a* which is the driving means for driving the same.

Here, the bag-shaped space formed by the fifth guide plate 11 and the side plate members 16F and 16R, which is the space between the fifth guide plate 11 and the second guide plate 9, is a conventional dead space existing below the second guide plate 9. By arranging the driving roller 18*d* and the first motor 17*a* for driving the same in this dead space, it is possible to efficiently utilize the space of the sheet conveying apparatus main body 54A.

Further, by arranging the first motor 17*a* not outside the sheet conveying apparatus main body 54A but inside the same, it is possible to make the space of the driving system compact, thus making it possible to minimize the width of the sheet conveying apparatus 54A as measured in the main scanning direction. As shown in FIG. 3, in this embodiment, the second and third motors 17*b* and 17*c* are also arranged inside the sheet conveying apparatus main body 54A. As a result, it is possible to achieve a reduction in the size of the sheet conveying apparatus 54 and the color image forming apparatus 50.

Further, by thus integrally arranging the fifth guide plate 11, the first motor 17*a*, etc. in the sub-casing 16, there is formed a rotation unit 20 rotatable independently of the sheet conveying apparatus main body 54A. When jamming occurs in the sheet conveying apparatus 54, jam processing is performed by rotating the rotation unit 20 independently of the sheet conveying apparatus main body 54A.

Next, the jam processing operation for the sheet conveying apparatus 54 constructed as described above will be described.

Figure 5:
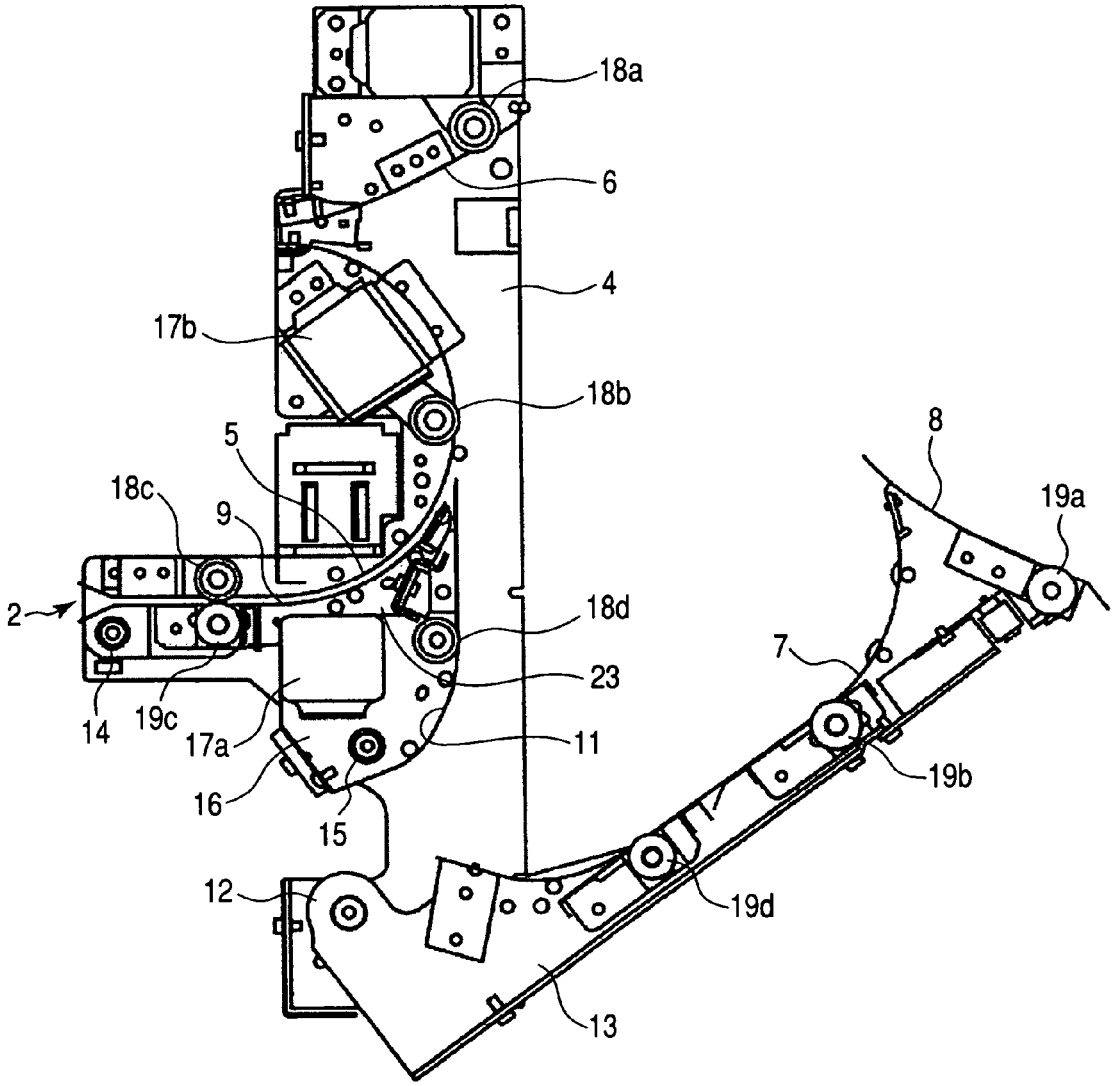
FIG. 5 is a first diagram illustrating the jam processing operation of the sheet conveying apparatus.

When jamming occurs, a stopper (not shown) is first released, and the engagement of the door-like casing 13 and the sheet conveying apparatus main body 54A is canceled. Thereafter, as shown in FIG. 5, the door-like casing 13 is downwardly rotated around the rotation shaft 12, whereby the sixth guide plate 7 and the fourth guide plate 8 forming the sheet conveying path 1 and the option conveying path 3 are downwardly rotated.

As a result, the sheet conveying path 1 and the option conveying path 3 are opened, and the driven rollers 19*a*, 19*b*, and 19*d* are separated from the driving rollers 18*a*, 18*b*, and 18*d*, whereby access to the sheets staying in the sheet conveying path 1 and the option conveying path 3 can be easily effected, and the staying sheets can be easily treated.

Figure 6:
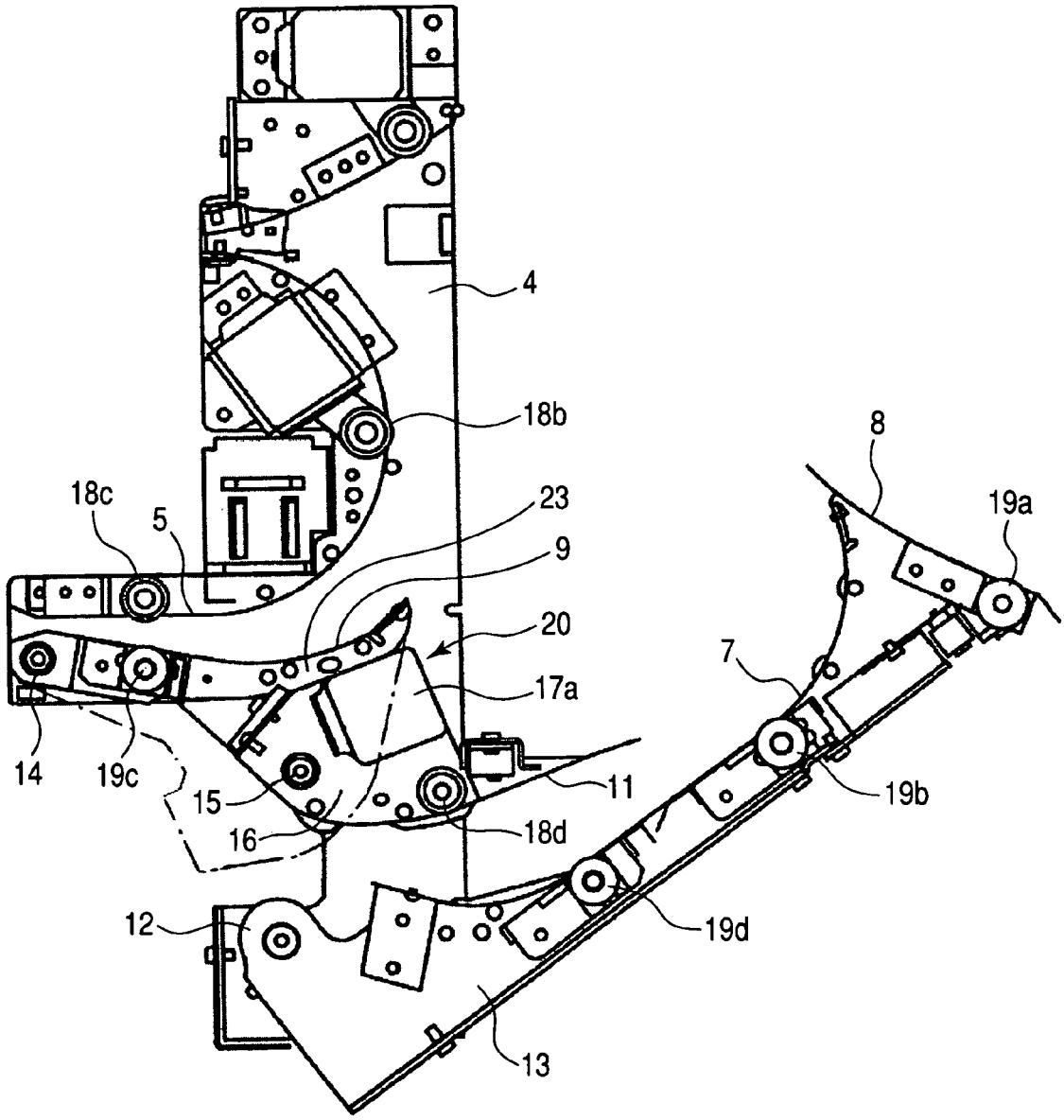
FIG. 6 is a second diagram illustrating the jam processing operation of the sheet conveying apparatus.

Next, the stopper (not shown) is released, and the rotation unit 20 is downwardly rotated until the state as shown in FIG. 6 is attained. Here, by downwardly rotating the rotation unit 20 as described above, it is possible to retract the fifth guide plate 11 and the first motor 17 from the lower space of the second guide plate 9.

As a result, it is possible to downwardly rotate a guide support member 23 supporting the second guide plate 9 around the rotation shaft 14 to separate the driving roller 19*c* from the driven roller 19*c*, with the result that there is generated a large open space also with respect to the inner sheet re-conveying path 2. That is, the guide support member 23 and the sub-casing 16 are dual structure, by rotating the guide support member 23 and the sub-casing 16 independently of each other around different rotation shafts, the second guide plate 9 and the fifth guide plate 11 rotate independently of each other, and the rotation angle of the second guide plate 9 can be large, making it possible to enlarge the open space.

That is, by rotating the rotation unit 20, and at the same time, rotating the fifth guide plate 11 integrally so as to move it away from the second guide plate 9, it is possible, as shown in FIG. 6, to utilize the conventional dead space between the conventional second guide plate 9 and the fifth guide plate 11 as an open space of the second guide plate 9.

Further, the rotation shaft 15 of the sub-casing 16 is arranged at position near the side, and rotation shaft 14 of the guide support member 23 is arranged inside the apparatus main body, so that, when the sub-casing 16 and the guide support member 23 are rotated, they do not interfere with the members of the sheet feeding apparatus 53, and it is possible to greatly rotate the guide support member 23. In FIG. 6, the dot-dash line indicates the locus when, as in the conventional construction, the sub-casing 16 and the guide support member 23 are integrally rotated.

In this way, by utilizing the space between the second guide plate 9 and the fifth guide plate 11, rotation is effected such that the fifth guide plate 11 moves away from the second guide plate 9, whereby it is possible to achieve a reduction in the size of the sheet conveying apparatus 54 and to enlarge the jam processing space, thereby facilitating the jam processing.

Further, in the conventional image forming apparatus, the driving motor for driving the conveying roller pair is mounted to the outer side of the sheet conveying apparatus placing priority on the accessibility at the time of maintenance. In the case in which the driving motor is thus mounted to the outer side of the sheet conveying apparatus, the depth dimension of the sheet conveying apparatus is rather large, and consequently, the depth dimension of the image forming apparatus is rather large. According to the present invention, however, this problem can also be solved.

Further, by providing such a sheet conveying apparatus 54, it is possible to achieve, in particular, in an image forming apparatus intended for high productivity and in an image forming apparatus whose output images are required to be of high commercial value, a marked effect in terms of installation space and the ease with which the apparatus is brought in, and also in terms of a reduction in down time when jamming occurs.

Next, the second embodiment of the present invention will be described.

Figure 7:
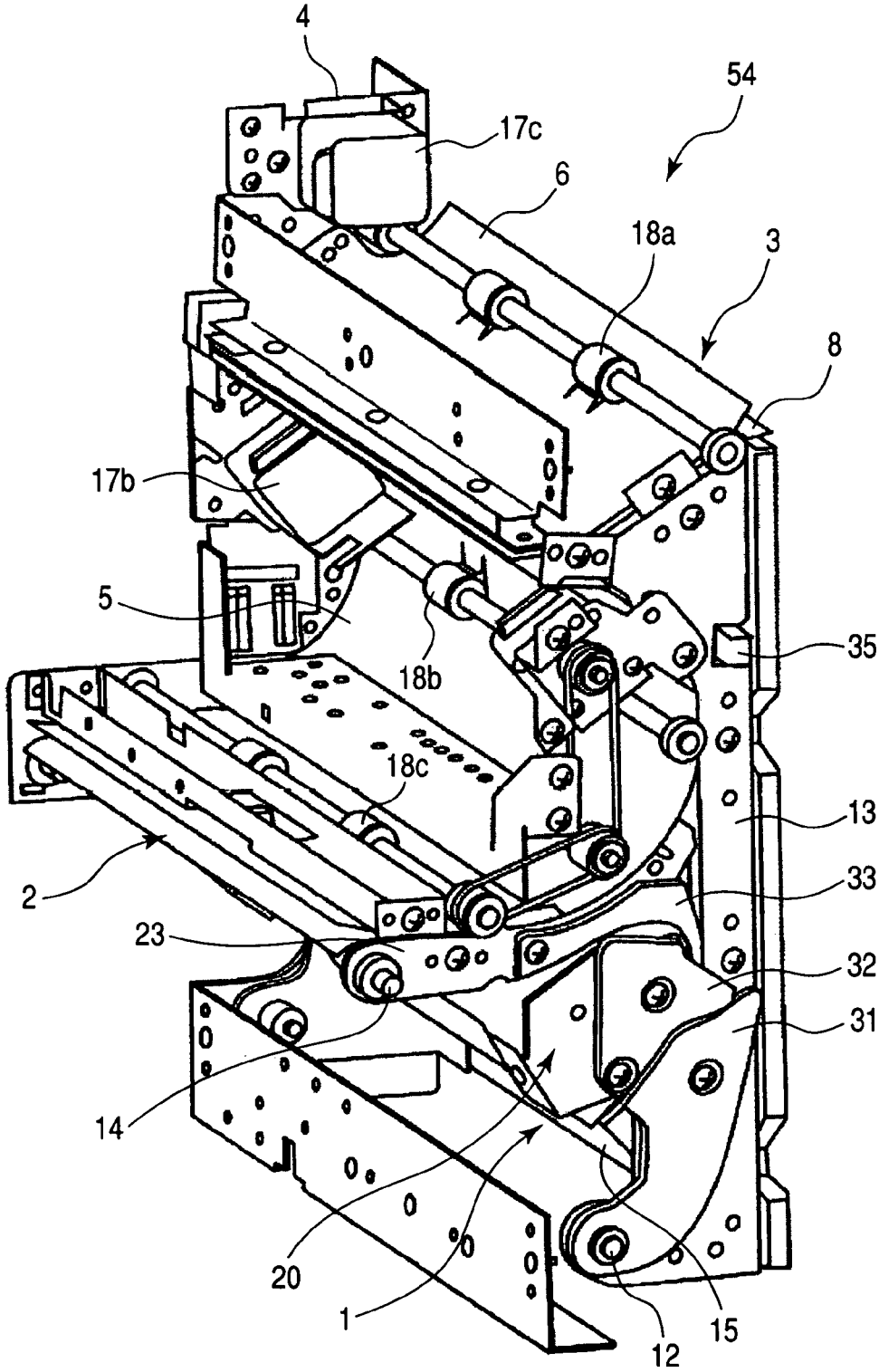
FIG. 7 is a perspective view of a sheet conveying apparatus according to a second embodiment of the present invention.

FIG. 7 is a perspective view of a sheet conveying apparatus according to this embodiment. In FIG. 7, the components that are the same as or equivalent to those in FIG. 3 are indicated by the same symbols.

In FIG. 7, reference numeral 31 indicates first cams fixed to both sides of the door-like casing 13, reference numeral 32 indicates second cams fixed to both sides of the rotation unit 20, and reference numeral 33 indicates third cams fixed to side surfaces of the guide support member 23 supporting the second guide plate 9.

Here, FIG. 7 shows the state in which an ordinary sheet is conveyed. At this time, the first cams 31 and the second cams 32 are in contact with each other, and the second cams 32 are not in contact with the third cams 33.

Figure 8:
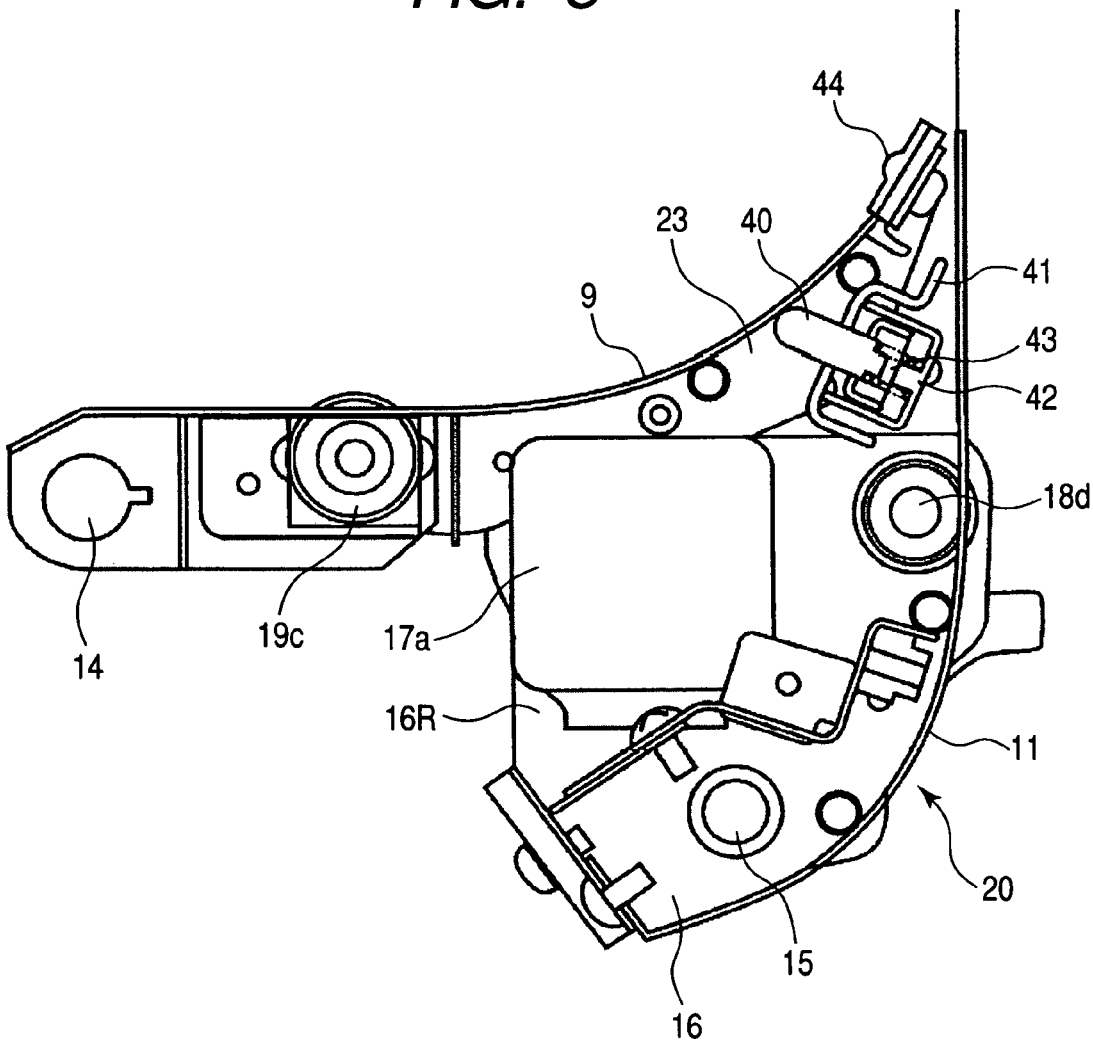
FIG. 8 is a diagram showing the positional relationship between a second guide plate and a fifth guide plate in normal sheet conveyance by the sheet conveying apparatus.

FIG. 8 is a diagram showing the positional relationship between the second guide plate 9 and the fifth guide plate 11 in this state. In FIG. 8, reference numeral 41 indicates a reinforcing plate provided between the side plate members 16F and 16R of the rotation unit 20, and a pressurizing member 40 abutting the second guide plate 9 slidably protrudes from the reinforcing plate 41. Here, the pressurizing member 40 is urged so as to protrude by an elastic member 43, and the second guide member 9 is pressurized upwards from behind by the pressurizing member 40.

Reference numeral 42 indicates a pressurizing stopper which is fixed to the reinforcing plate 41 and in which the elastic member 43 is sealed. The pressurizing member 40 is slidably arranged in this pressurizing stopper so as to protrude from the reinforcing plate 41 by an amount according to the state in which it abuts the second guide plate 9.

Due to this construction of the pressurizing member 40, when the second guide plate 9 is pressurized by the pressurizing member 40, the rotation unit 20 receives a reaction force from the elastic member 43. As a result, due to the pressurizing member 40, the guide support member 23 supporting the second guide plate 9 is pressurized so as to be pushed obliquely upwards with respect to the rotation shaft 14, and the rotation unit 20 is pressurized so as to be pushed obliquely downwards with respect to the rotation shaft 15.

Here, the guide support member 23 supporting the second guide plate 9 has an abutment portion 44 at a position deviated on either side from the position where the sheet passes. When raised, the abutment portion 44 abuts a fixation member (not shown) provided in the sheet conveying apparatus main body 54A, whereby positioning is effected on the second guide plate 9 such that it is spaced apart from the first guide plate 5 by a fixed amount.

As shown in FIG. 7, by pressurizing the second cams 32 against the first cams 31 of the door-like casing 13 by the reaction force from the elastic member 43, positioning is effected on the rotation unit 20 such that the distance between the fifth guide plate 11 and the sixth guide plate 6 is a fixed amount. That is, the abutment portion 44 of the guide support member 23 upwardly pressurized by the pressurizing member 40 is caused to abut the fixation member (not shown) provided in the sheet conveying apparatus main body 54A, and the second cams 32 are pressurized against the first cams 31 of the door-like casing 13, whereby positioning is effected on the second guide plate 9 and the rotation unit 20 such that their respective guide plate intervals are fixed.

By arranging a plurality of such pressurizing portions 40, which are positioning means for effecting positioning on the rotation unit 20 and the second guide plate 9, uniformly in the main scanning direction, it is possible to achieve a further improvement in terms of the positioning accuracy for the second guide plate 9 and the rotation unit 20.

Further, in this embodiment, the positional relationship between the center of gravity of the door-like casing 13, to which the first cams 31 are fixed, and the rotation shaft 12 of the door-like casing 13 is set such that the door-like casing 13 is opened by its own weight (rotates downwards), whereby the door-like casing 13 is constantly urged toward the outer side, that is, so as to downwardly rotate. Normally, positioning is effected on the door-like casing 13 constructed as described above by engaging a lock member 35 shown in FIG. 7 with a lock portion (not shown) provided in the sheet conveying apparatus main body 54A.

In this way, positioning is effected on the door-like casing 13 with respect to the sheet conveying apparatus main body 54A by engaging the lock member 35 with the lock portion (not shown); positioning is effected on the rotation unit 20 with respect to the door-like casing 13; and further, positioning is effected on the second guide plate 9 by causing the abutment portion 44 of the guide support member 23 to abut the fixation member (not shown), whereby the inter-guide-plate distance of the sheet conveying path 1 and the sheet re-conveying path 2 can be easily set to a desired distance.

As a result, also in the case of a sheet conveying path which, as in this embodiment, is equipped with a joining portion composed of a plurality of separated guide plates (the fifth guide plate 11 and the sixth guide plate 7), it is possible to maintain the requisite inter-guide-plate distance reliably and easily.

On the other hand, when the door-like casing 13 is opened by the reaction force between the second guide plate 9 and the rotation unit 20 and the falling of the door-like casing 13 due to its own weight, the rotation unit 20 rotates in synchronism therewith, and further, with this rotation of the rotation unit 20, the second guide plate 9 downwardly rotates. As a result, when jamming occurs in the sheet conveying apparatus 54, it is possible to simultaneously open the plurality of sheet conveying paths 1 through 3 solely through a single operation of opening the door-like casing 13. Further, by causing the door-like casing 13 to fall by its own weight, the plurality of sheet conveying paths 1 through 3 can be opened with small force.

Thus, the first through third cams 31 through 33, the elastic member 43, etc. form an interlock means which causes the rotation unit 20 and the fifth guide plate 11 to rotate in synchronism with the rotating operation of the door-like casing 13 fixing the sixth guide plate 7 forming the sheet conveying path 1.

Next, the jam processing operation of the sheet conveying apparatus 54 will be described.

Figure 9:
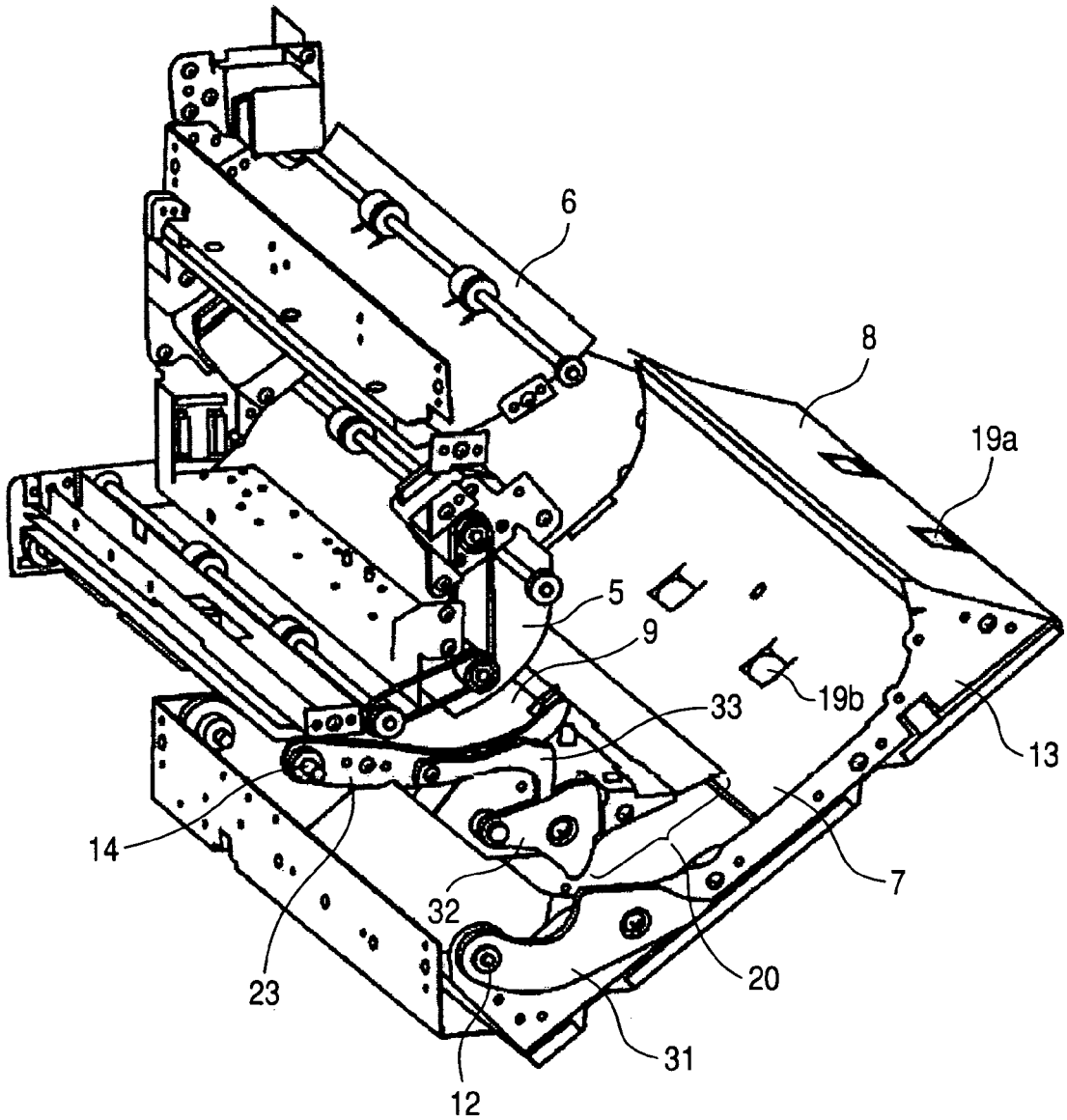
FIG. 9 is a diagram illustrating the jam processing operation of the above sheet conveying apparatus.

First, when the engagement of the lock member 35 is canceled through operation of a handle (not shown) provided on the door-like casing 13, the door-like casing 13 downwardly rotates, as shown in FIG. 9, by its own weight until it is regulated by a regulating member (not shown), and the sheet conveying path 1 and the option conveying path 3 are opened. Further, when the door-like casing 13 thus rotates, the rotation unit 20, which has been held by the door-like casing 13 by keeping the second cams 32 in contact with the first cams 31 of the door-like casing 13, downwardly rotates according to the opening degree of the door-like casing 13, with the second cams 32 being held in slide contact with the first cams 31 as the door-like casing 13 rotates, whereby the rotation unit 20 rotates smoothly.

On the other hand, the second cams 32 and the third cams 33 do not come into contact with each other in the state shown in FIG. 7 described above, and the mutual positional relationship between the second guide plate 9 and the rotation unit 20 is fixed through abutment by the pressurizing member 40; however, when the rotation unit 20 downwardly thus rotates with the opening operation of the door-like casing 13, the second guide plate 9 rotates downwardly together with the guide support member 23, and transition is effected to a state in which the third cams 33 are in contact with the second cams 32.

That is, when the door-like casing 13 is opened, the rotation unit 20 rotates downwardly while keeping the second cams 32 in contact with the first cams 31, and, when the rotation unit 20 further rotates downwardly, the second guide plate 9 rotates downwardly together with the guide support member 23 while keeping the second cams 32 in contact with the third cams 33.

Here, the rotating amount (retracting amount) of the rotation unit 20 and the rotating amount of the second guide plate 9 are in correspondence with the opening amount of the door-like casing 13. In FIG. 9, the position of the rotation unit 20 is regulated by an abutment member (not shown) or the like, and solely the door-like casing 13 is further rotated to further enlarge the jam processing space. Thus, the first cams 31 and the second cams 32 are separated from each other.

By thus rotating the rotation unit 20 and the second guide plate 9 downwards through the operation of opening the door-like casing 13, the sheet conveying path 1, the sheet re-conveying path 2, and the option conveying path 3 can be easily opened, and a plurality of conveying paths can be opened by one operation, thereby facilitating the jam processing and facilitating the operation by the user.

When, thereafter, the jam processing is completed and the door-like casing 13 is rotated upwardly, the first cams 31 come into contact with the second cams 32, whereby the rotation unit 20 rotates upwards together with the door-like casing 13. Further, when the rotation unit 20 thus upwardly rotates together with the door-like casing 13, the second guide plate 9, which has been downwardly rotating while keeping the third cams 33 in contact with the second cams 32, rotates upwardly.

When the second guide plate 9 rotates to a predetermined position, the contact of the third cams 33 with the second cams 32 is canceled. Thereafter, the second guide plate 9 rotates to a position where it is held while kept in contact with the pressurizing member 40 of the rotation unit 20 shown in FIG. 8.

By thus providing an interlock means formed by the first through third cams 31 through 33, the plurality of sheet conveying paths 1 through 3 can be opened easily and to a sufficient degree solely through rotation of the door-like casing 13. Further, when the door-like casing 13 is closed, all the sheet conveying paths 1 through 3 can be restored to positions allowing conveyance through a single operation. Further, by synchronizing all the operations by the first through third cams 31 through 33, it is possible to uniquely determine the complicated operation sequence, so that it is possible to prevent dynamic interference, failure, etc. due to erroneous operation.

Further, due to the configurations of the first through third cams 31 through 33, it is possible to adjust the operational timing of the door-like casing 13, the rotation unit 20, and the second guide plate 9, so that it is possible to effect regulation such that the second guide plate 9 does not rotate downwardly before the first motor 17*a* has retracted, thereby making it possible to reliably control the operation of opening a plurality of sheet conveying paths.

Figure 10:
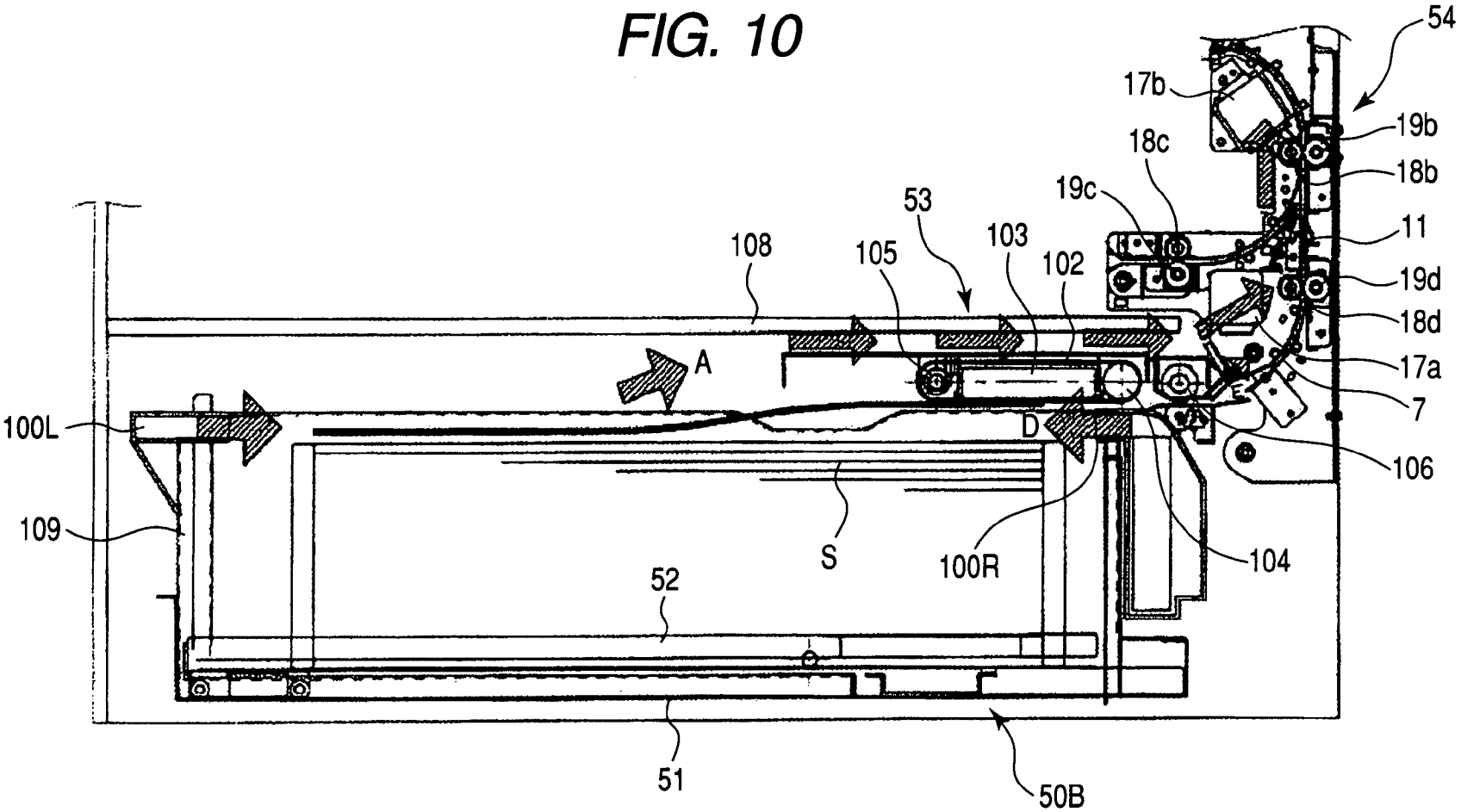
FIG. 10 is a diagram showing an air sheet feeding apparatus and a sheet conveying apparatus.
Figure 11:
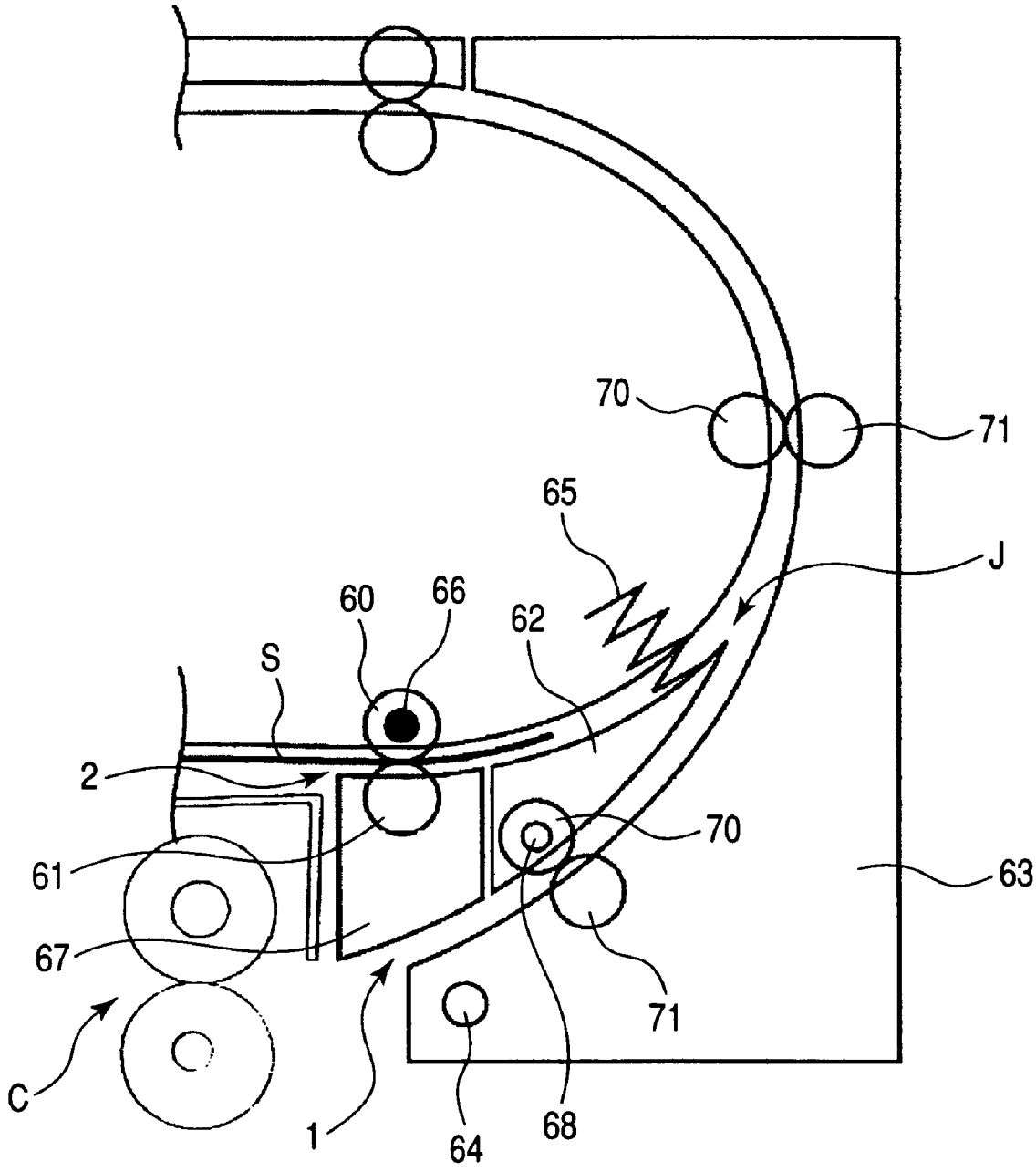
FIG. 11 is a diagram showing the construction of a conventional sheet conveying apparatus.
Figure 12:
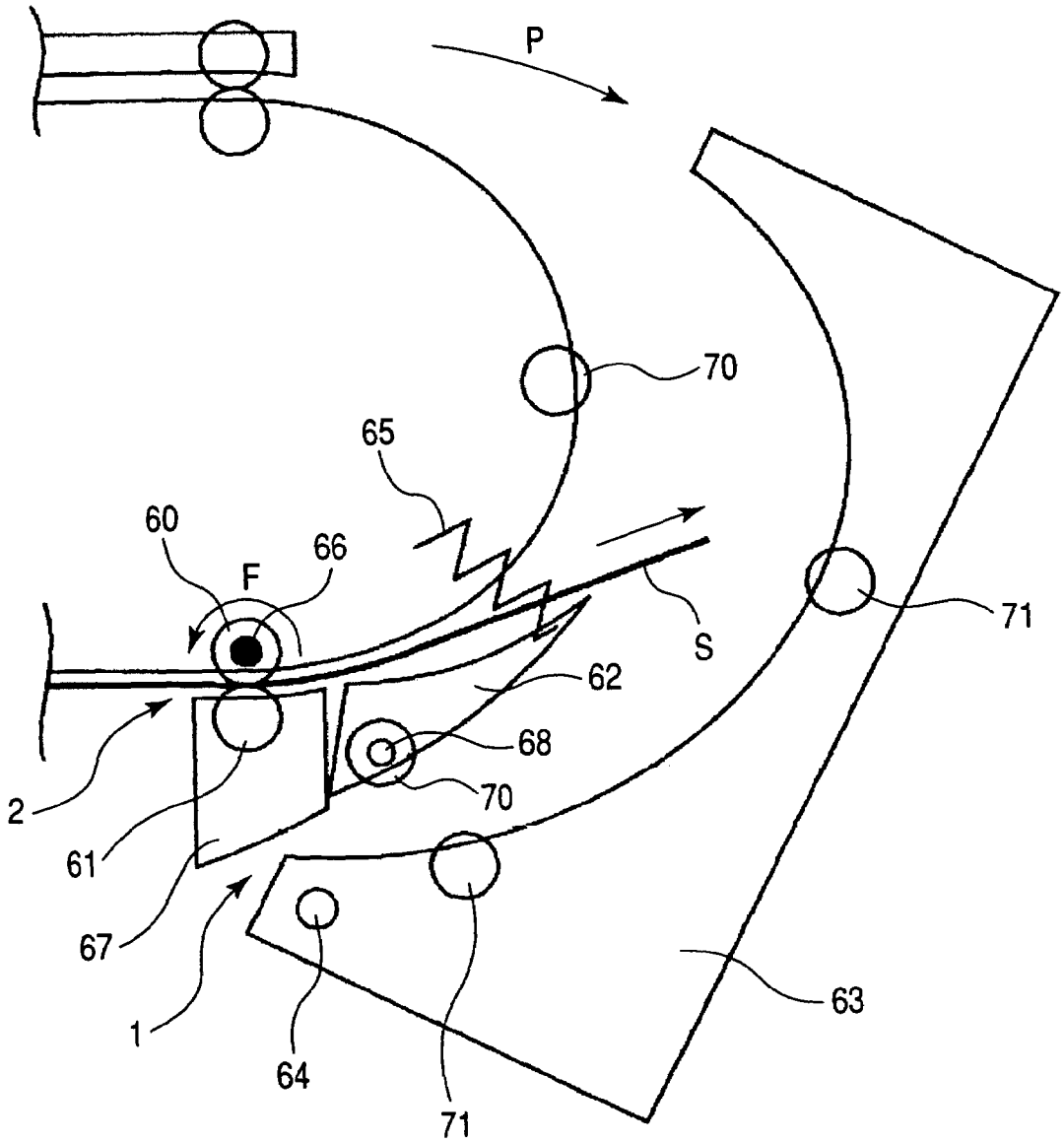
FIG. 12 is a diagram illustrating the jam processing operation of the conventional sheet conveying apparatus.

FIG. 10 is a partial sectional view, as seen from the inner side, of the image forming apparatus 50, showing a guide plate delivery portion of an air feed type sheet feeding portion 50B and the sheet conveying apparatus 54 adjacent thereto, the sectional view being taken along an imaginary line near the center of the guide plate. The sheet feeding portion 50B is composed of a sheet accommodating portion 51 formed by a lift-up device 52 on which sheets are stacked, an apparatus casing 109, etc., and a sheet feeding means 53 for feeding the sheets one by one to the sheet conveying apparatus 54.

The sheet accommodating portion 51 is equipped with a sheet raising fan (not shown), and there are formed nozzles 100R and 100L which blow air guided from the sheet raising fan via a duct, etc. toward the sheet stack S2 in the sheet accommodating portion 51. The nozzles 100R and 100L separate and raise several top sheets of the stack S by loosening the sheets by air. For this purpose, the nozzles 100R and 100L are set so as to aim at the portions of the sheet stack S near the top sides thereof. Further, in order to reliably raise sheets of large basis weight, a construction will prove more effective in which a plurality of sheet raising fans are provided, with the nozzles being set so as to aim at the sheet stack from a plurality of sides.

In the example shown in FIG. 10, the nozzles 100R and 100L are provided so as to blow air from two opposing sides (as indicated by the arrows D in FIG. 10). Further, the sheet feeding means is equipped a attraction-conveyance belt 102, rollers 104 and 105 for stretching and driving the belt, and an attraction duct 103. Here, the attraction duct 103 is provided inside the attraction-conveyance belt 102, and the attraction-conveyance belt 102 has in its surface a plurality of holes for ventilation. A sheet attracting fan (not shown) connected to the attraction duct 103 is provided, for example, on the rear surface of the sheet accommodating portion 51.

Due to the above fan construction, the sheet stack S is first loosened by air from the sheet raising fan (arrows D in FIG. 10), and several top sheets are raised. Subsequently, the uppermost sheet is attracted to the surface of the attraction-conveyance belt 102 by the air from the sheet attracting fan. At this time, the air from the sheet raising fan is intercepted by a shutter or the like, whereby solely the single sheet attracted to the surface of the attraction-conveyance belt 102 is reliably fed, and double feed of sheets is prevented. In this way, the attraction-conveyance belt 102 is caused to perform conveying operation by the rollers 104 and 105 while keeping the sheet on its surface, and delivers the sheet to a pull-out roller pair 106, thus performing sheet feeding operation. The outline of the basic sheet feeding operation of the sheet feeding portion 50B is as described above; in the case of successive feeding, the above operation is repeated.

The driving motor 17*a* is fixed to the inner side of the sub-casing 16 (which, in this example, is the rear side plate 16R), with solely the rotor portion thereof protruding on the outer side of the rear side plate 16R. Further, as shown in FIG. 10, the driving motor 17*a* is arranged in the immediate vicinity of the pull-out roller pair 106 of the air sheet feeding apparatus 100. Further, a portion of the casing of the image forming apparatus constitutes a partition plate 108 separating the air sheet feeding apparatus 100 and the image forming portion from each other. Thus, the driving motor 17*a* of the sheet conveying apparatus 54 is arranged at a position where it is substantially opposed to a discharge port through which sheets are discharged from the air sheet feeding apparatus 100.

It is possible to utilize the sheet raising air discharged from the sheet feeding portion 50B as air for cooling the driving motor 17*a*. In order to reliably raise sheets of large basis weight and sheets of large size, the sheet raising fan blows an overwhelmingly larger quantity of air than a cooling fan provided in an ordinary image forming apparatus, and the airflow velocity is higher due to the nozzle effect.

Further, in FIG. 10, the raising air blown from two sides (as indicated by the arrows D in FIG. 10) escapes as an airflow A along the partition 8 and as an airflow E through the gap of the guide plate outlet. Thus, the sheet raising air is discharged from the sheet discharging port side of the sheet feeding portion 50B in FIG. 10, and the driving motor 17*a*, which is arranged on the inner side so as to be substantially opposed to the sheet discharging port, is situated in the airflow E. As a result, it is possible to form an airflow with a sufficient quantity of air without having to form a dedicated fan and duct for cooling the driving motor 17*a* situated on the inner side 17*a*. As a result, it is possible to cope with an increase in the RPM and in continuous operating period of the driving motor due to an enhancement in the productivity of the image forming apparatus with a small space and a small number of parts.

Even in such an image forming apparatus as equipped with an air sheet feeding type sheet feeding portion 50B, in particular, in an image forming apparatus intended for high productivity or an image forming apparatus whose output images are required to be of high commercial value, it is possible to realize a sheet conveying apparatus making it possible to obtain the effect of restraining an increase in the size of the apparatus main body, which is advantageous from the viewpoint of installation space and the ease with which the apparatus can be transported and brought in, and the effect of cooling the driving motor under high RPM condition.

This application claims priority from Japanese Patent Application No. 2004-096919 filed Mar. 29, 2004, which is hereby incorporated by reference herein.

What is claimed is:

1. A sheet conveying apparatus comprising:

a first sheet conveying path that is opened by opening a casing rotatably mounted to an apparatus main body;

a second sheet conveying path arranged inside of the apparatus main body and joining the first sheet conveying path;

a first guide member constituting one side of the first sheet conveying path at a joining portion where the first sheet conveying path and the second sheet conveying path join each other;

a first guide support member rotatably provided between respective upstream portions of the first sheet conveying path and the second sheet conveying path from the joining portion in the sheet conveying direction and supporting the first guide member;

a second guide member constituting one side of the second sheet conveying path;

a second guide support member rotatably provided between the respective upstream portions of the first sheet conveying path and the second sheet conveying path and supporting the second guide member; and an elastic member urging the first guide support member and the second guide support member away from each other, wherein the first sheet conveying path is formed by causing the first guide support member to abut against the casing by the elastic member and the second sheet conveying path is formed by causing the second guide support member to abut against the apparatus main body by the elastic member, wherein, when the casing is opened, the first guide support member and the second guide support member rotate independently of each other to open the second sheet conveying path.

2. A sheet conveying apparatus according to claim 1, further comprising abutment means between the first guide support member and the casing and having a first cam provided on the casing and a second cam provided on the first guide support member and being slidably contactable with the first cam, wherein the second cam abuts against the first cam to effect positioning of the first guide support member and the casing, and wherein, when the casing is opened, the first guide support member rotates, with the cams being in slide contact with each other.

3. A sheet conveying apparatus according to claim 2, wherein the casing is rotatable between a position where the casing is locked to the apparatus main body and a position where the locking is released and the casing rotates by its own weight to open the first sheet conveying path.

4. A sheet conveying apparatus according to claim 2, wherein the second guide support member is provided with a third cam slidably contactable with the second cam provided on the first guide support member, and wherein, when the first guide support member rotates, the second guide support member also rotates, and the third cam of the second guide support member is engaged with the second cam of the first guide support member to regulate a rotation of the second guide support member.

5. A sheet conveying apparatus comprising:

a first sheet conveying path that is opened by opening a casing rotatably mounted to an apparatus main body;

a second sheet conveying path arranged inside of the apparatus main body and joining the first sheet conveying path;

a first guide member constituting one side of the first sheet conveying path at a joining portion where the first sheet conveying path and the second sheet conveying path join each other;

a first guide support member rotatably provided between respective upstream portions of the first sheet conveying path and the second sheet conveying path from the joining portion in the sheet conveying direction and supporting the first guide member;

a second guide member constituting one side of the second sheet guide conveying path; and a second guide support member rotatably provided between the respective upstream portions of the first sheet conveying path and the second sheet conveying path and supporting the second guide member, wherein when the casing is opened, the first guide support member and the second guide support member rotate independently of each other to open the second sheet conveying path, and wherein a conveying roller pair for conveying a sheet is arranged in the first sheet conveying path, and wherein driving means for driving the conveying roller pair is mounted in a space formed by the first guide member and the second guide member, the first guide member holding the driving means to rotate integrally with the driving means.

6. A sheet conveying apparatus according to claim 5, wherein the first sheet conveying path is arranged at a position where the first sheet conveying path guides a sheet sent out from a sheet accommodating portion by a sheet feeding portion, and wherein the sheet feeding portion comprises an air loosening means for loosening sheets by blowing air against the sheets, the sheet conveying apparatus further comprising a duct structure guiding the air blown by the air loosening means to a drive source.

7. An image forming apparatus comprising:

a first sheet conveying path that is opened by opening a casing provided on a side surface of an apparatus main body;

a second sheet conveying path arranged inside of the apparatus main body and joining the first sheet conveying path;

a first guide member constituting one side of the first sheet conveying path at a joining portion where the first sheet conveying path and the second sheet conveying path join each other;

a first guide support member rotatably provided between respective upstream portions of the first sheet conveying path and the second sheet conveying path from the joining portion in a sheet conveying direction and supporting the first guide member;

a second guide member constituting one side of the second sheet conveying path at the joining portion;

a second guide support member rotatably provided between the respective upstream portions of the first sheet conveying path and the second sheet conveying path and supporting the second guide member;

an elastic member urging the first guide support member and the second guide support member away from each other, wherein the first sheet conveying path is formed by causing the first guide support member to abut against the casing by the elastic member and the second sheet conveying path is formed by causing the second guide support member to abut against the apparatus main body by the elastic member; and an image forming portion arranged on a downstream side of the joining portion with respect to a sheet conveying direction and adapted to form an image on a sheet, wherein, when the casing is opened, the first guide support member and the second guide support member rotate independently of each other to open the second sheet conveying path.

8. An image forming apparatus according to claim 7, wherein the first sheet conveying path is a sheet conveying path for conveying the sheet to the image forming portion, and wherein the second sheet conveying path is a sheet re-conveying path for conveying the sheet on which an image has been formed by the image forming portion to the image forming portion again.

9. An image forming apparatus according to claim 7, further comprising abutment means between the first guide support member and the casing and having a first cam provided on the casing and a second cam provided on the first guide support member and being slidably contactable with the first cam, wherein the second cam abuts against the first cam to effect positioning of the first guide support member and the casing, and wherein, when the casing is opened, the first guide support member rotates, with the cams being in slide contact with each other.

10. An image forming apparatus according to claim 9, wherein the second guide support member is provided with a third cam slidably contactable with the second cam provided on the first guide support member, and wherein, when the first guide support member rotates, the second guide support member also rotates, and the third cam of the second guide support member is engaged with the second cam of the first guide support member to regulate a rotation of the second guide support member.

11. An image forming apparatus comprising:

a first sheet conveying path that is opened by opening a casing provided on a side surface of an apparatus main body;

a second sheet conveying path arranged inside of the apparatus main body and joining the first sheet conveying path;

a first guide member constituting one of side of the first sheet conveying path at a joining portion where the first sheet conveying path and the second sheet conveying path join each other;

a first guide support member rotatably provided between respective upstream portions of the first sheet conveying path and the second sheet conveying path from the joining portion in a sheet conveying direction and supporting the first guide member;

a second guide member constituting one side of the second sheet conveying path at the joining portion;

a second guide support member rotatably provided between the respective upstream portions of the first sheet conveying path and the second sheet conveying path and supporting the second guide member; and an image forming portion arranged on a downstream side of the joining portion with respect to a sheet conveying direction and adapted to form an image on a sheet, wherein, when the casing is opened, the first guide support member and the second guide support member rotate independently of each other to open the second sheet conveying path, and wherein a conveying roller pair for conveying a sheet is arranged in the first sheet conveying path, and wherein driving means for driving the conveying roller pair is mounted in a space formed by the first guide member and the second guide member, the first guide member holding the driving means to rotate together with the driving means.

12. An image forming apparatus according to claim 7, wherein the first sheet conveying path is arranged at a position where the first sheet conveying path guides a sheet sent out from a sheet accommodating portion by a sheet feeding portion, and wherein the sheet feeding portion comprises air loosening means for loosening sheets by blowing air against the sheets, the image forming apparatus further comprising a duct structure guiding the air blown by the air loosening means to a drive source.

13. A sheet conveying apparatus comprising:

a first sheet conveying path;

a second sheet conveying path which joins the first sheet conveying path at a joining portion;

a guide support portion arranged between respective upstream portions of the first sheet conveying path and the second sheet conveying path from the joining portion in a sheet conveying direction, and the guide support portion being divided into a first guide support member to support a first guide member to constitute the first sheet conveying path and second guide support member to support a second guide member to constitute the second conveying path, and the first guide support member and the second guide support member being rotatable independent of each other about different pivots; and an elastic member urging the first guide support member and the second guide support member away from each other, wherein the first sheet conveying path is formed by causing the first guide support member to abut against a casing rotatably mounted to an apparatus main body by the elastic member and the second sheet conveying path is formed by causing the second guide support member to abut against the apparatus main body by the elastic member.

14. A sheet conveying apparatus according to claim 13, wherein a conveying roller pair for conveying a sheet is arranged in the first sheet conveying path, and wherein driving means for driving the conveying roller pair is mounted in a space formed by the first guide member and the second guide member, the first guide member holding the driving means to rotate integrally with the driving means.

15. An image forming apparatus comprising:

a first sheet conveying path;

a second sheet conveying path which joins the first sheet conveying path at a joining portion;

a guide support portion arranged between respective upstream portions of the first sheet conveying path and the second sheet conveying path from the joining portion in a sheet conveying direction, and the guide support portion being divided into a first guide support member to support a first guide member to constitute the first sheet conveying path and a second guide support member to support a second guide member to constitute the second conveying path, and the first guide support member and the second guide support member being rotatable independent of each other about different pivots;

an elastic member urging the first guide support member and the second guide support member away from each other, wherein the first sheet conveying path is formed by causing the first guide support member to abut against a casing rotatably mounted to an apparatus main body by the elastic member and the second sheet conveying path is formed by causing the second guide support member to abut against the apparatus main body by the elastic member; and an image forming portion adapted to form an image on a sheet conveyed by the first sheet conveying path and the second sheet conveying path.

16. An image forming apparatus according to claim 15, wherein a conveying roller pair for conveying a sheet is arranged in the first sheet conveying path, and wherein driving means for driving the conveying roller pair is mounted in a space formed by the first guide member and the second guide member, the first guide member holding the driving means to rotate together with the driving means.

* * * * *